US012421706B1

(12) United States Patent
Hu

(10) Patent No.: US 12,421,706 B1
(45) Date of Patent: Sep. 23, 2025

(54) SINK STRAINER WITH CHANNELS ALLOWING WATER FLOW

(71) Applicant: Jack Kirk Hu, Pleasanton, CA (US)

(72) Inventor: Jack Kirk Hu, Pleasanton, CA (US)

(73) Assignee: GoGetter Inventions LLC, Pleasanton, CA (US)

( * ) Notice: Subject to any disclaimer, the term of this patent is extended or adjusted under 35 U.S.C. 154(b) by 0 days.

(21) Appl. No.: 19/217,999

(22) Filed: May 23, 2025

Related U.S. Application Data

(60) Provisional application No. 63/671,345, filed on Jul. 15, 2024.

(51) Int. Cl.
*E03C 1/264* (2006.01)

(52) U.S. Cl.
CPC ..... *E03C 1/264* (2013.01)

(58) Field of Classification Search
CPC .. E03C 1/264; E03C 1/262; E03C 1/26; E03F 5/0407; A47K 1/14
See application file for complete search history.

(56) References Cited

U.S. PATENT DOCUMENTS 2,440,165 A * 4/1948 Behrend ..... E03C 1/264 4/652
2,695,411 A * 11/1954 Vinokor ..... E03C 1/264 4/292
7,736,499 B2 * 6/2010 Chong ..... E03C 1/264 4/290

* cited by examiner

*Primary Examiner* — Janie M Loeppke
(74) *Attorney, Agent, or Firm* — QuickPatents; Kevin Prince

(57) ABSTRACT

A sink strainer with water flow channels that allow the strainer to drain water even when covered with food debris. Each water flow channel increases the water flow efficiency of the strainer by adding water entry places that are not found in traditional strainers. For instance, water is allowed to flow through the rim of the present sink strainer. Each water flow channel includes a perforated raised rim ridge that allows water to enter the strainer through the edge of the rim and through the top of the rim. Each water flow channel also includes a perforated lower tunnel that adds additional water entry places to the perforated cup of the stainer. The preferred embodiment of the present sink strainer includes four perforated water flow channels that are spaced equally around the strainer.

9 Claims, 5 Drawing Sheets

SINK STRAINER WITH CHANNELS ALLOWING WATER FLOW

CROSS REFERENCE TO RELATED APPLICATIONS

This application claims the benefit of U.S. Provisional Patent Application 63/671,345, filed on Jul. 15, 2024, and incorporated herein by reference.

STATEMENT REGARDING FEDERALLY SPONSORED RESEARCH AND DEVELOPMENT

Not Applicable.

FIELD OF THE INVENTION

This invention relates to sink strainers, and more particularly to an improved sink strainer that prevents clogs.

BACKGROUND

Kitchen sinks are notoriously well known for becoming clogged. After dinner, food is washed off of plates and into the kitchen sink. Before long, water is backing up in the sink because the strainer has become clogged and you have a "swamp-sink". One of the responses to this scenario is to walk away for 10 to 20 minutes and give the water enough time to slowly drain away. Then remove all of the material from the sink that caused the clog, and, finally, remove the strainer and clean the strainer. Of course, if you don't want to wait for 10 to 20 minutes, you could just pull the strainer along with the debris stuck in it. However, this allows the rest of the debris in the sink to go down the drain, possibly clogging the drain. Moreover, a clogged drain will cause a much bigger problem than just a clogged sink strainer.

There are a number of sink strainers on the market that attempt to solve this sink clogging problem. Some of these solutions attempt to filter debris uniformly in any scenario, such as a simple, screen strainer. But this solution fails to meet the needs of industry because once filled with debris, the uniform shape of the device prevents further water flow and the sink clogs. Another attempted solution creates a single channel, in the form of a stem, in the center of the strainer. But this design is similarly unable to meet the needs of industry because the height of the stem becomes cumbersome, and the stem itself can be clogged. Still other solutions seek to facilitate water flow, but these solutions also fail to meet industry needs because the increased water flow they offer is not efficient, resulting in clogs.

Therefore, there is a need for a sink strainer that provides increased water flow so that clogs are prevented. The ideal sink strainer would have multiple water flow channels so that water flows efficiently through the strainer, even when the strainer is covered with food debris. The present invention accomplishes these objectives.

SUMMARY OF THE INVENTION

The present device is a sink strainer for preventing clogs. The sink strainer comprises a rim that is adapted to sit at the bottom of a sink, on top of the drain. The rim has an exterior circumference that is greater than the drain's circumference and an interior circumference that is connected to a perforated cup. The perforated cup extends down the drain a distance from the rim. The perforated cup comprises a circular top portion connected to the rim's interior circumference, a perforated bottom portion, and a perforated cylindrical wall connecting the top and bottom portions.

The sink strainer further comprises multiple perforated water flow channels. Each channel comprises a perforated face plate extending above the rim's exterior circumference, a perforated upper ridge extending above the rim and a perforated lower tunnel extending above the cup's cylindrical wall. The water flow channels allow water to flow through the strainer and into the drain even when the sink contains material that would clog a traditional screen strainer.

The present invention prevents water from backing up in a sink that has food debris covering the strainer, thereby preventing a swamp-sink. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element. When the words "substantially" or "about" are used, if a quantitative measurement is necessary, within 95% of "complete" or "exact" should be considered the meaning.

The term "the invention" or "the present invention" should always be construed as "an embodiment of the invention."

Figure 1A:
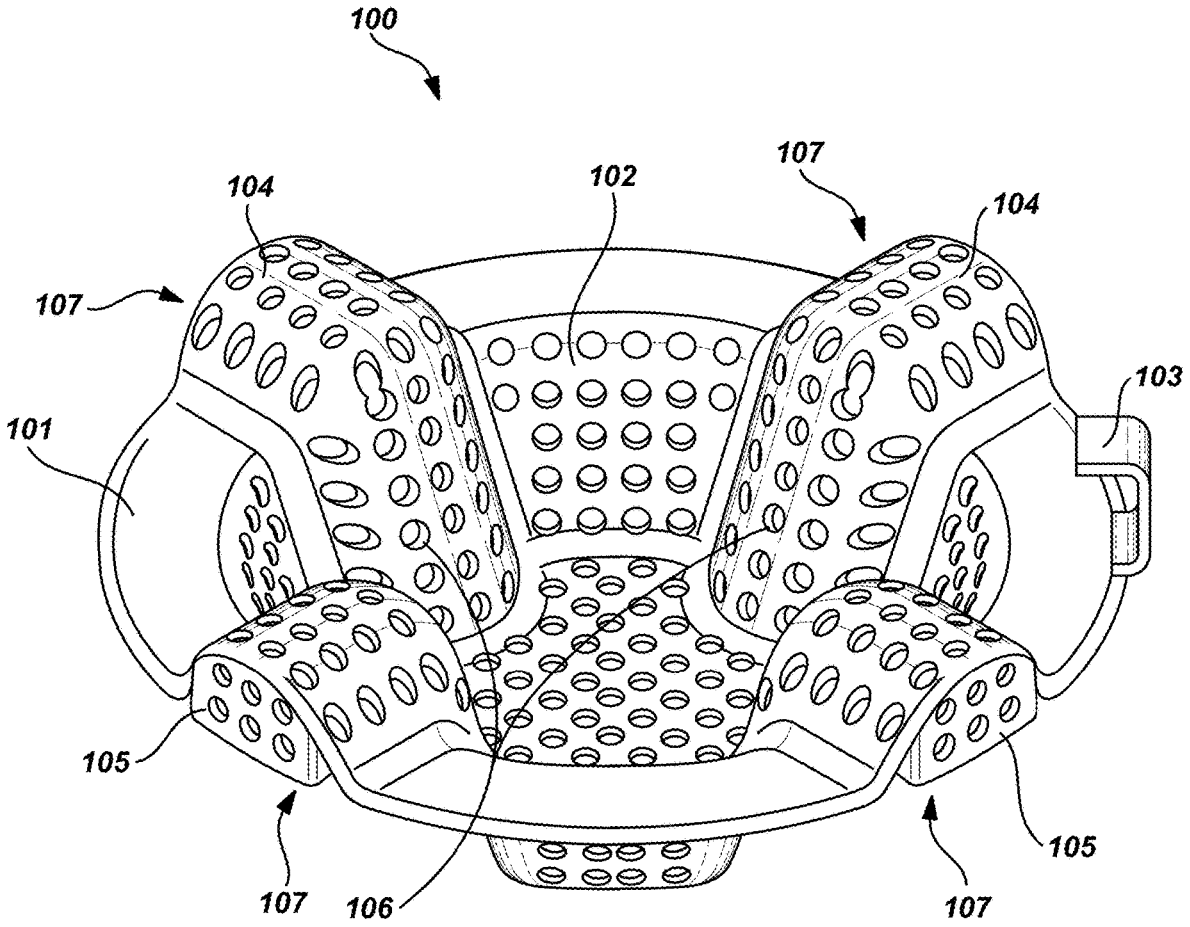
FIG. 1A is a top perspective view of one embodiment of the present invention.
Figure 1B:
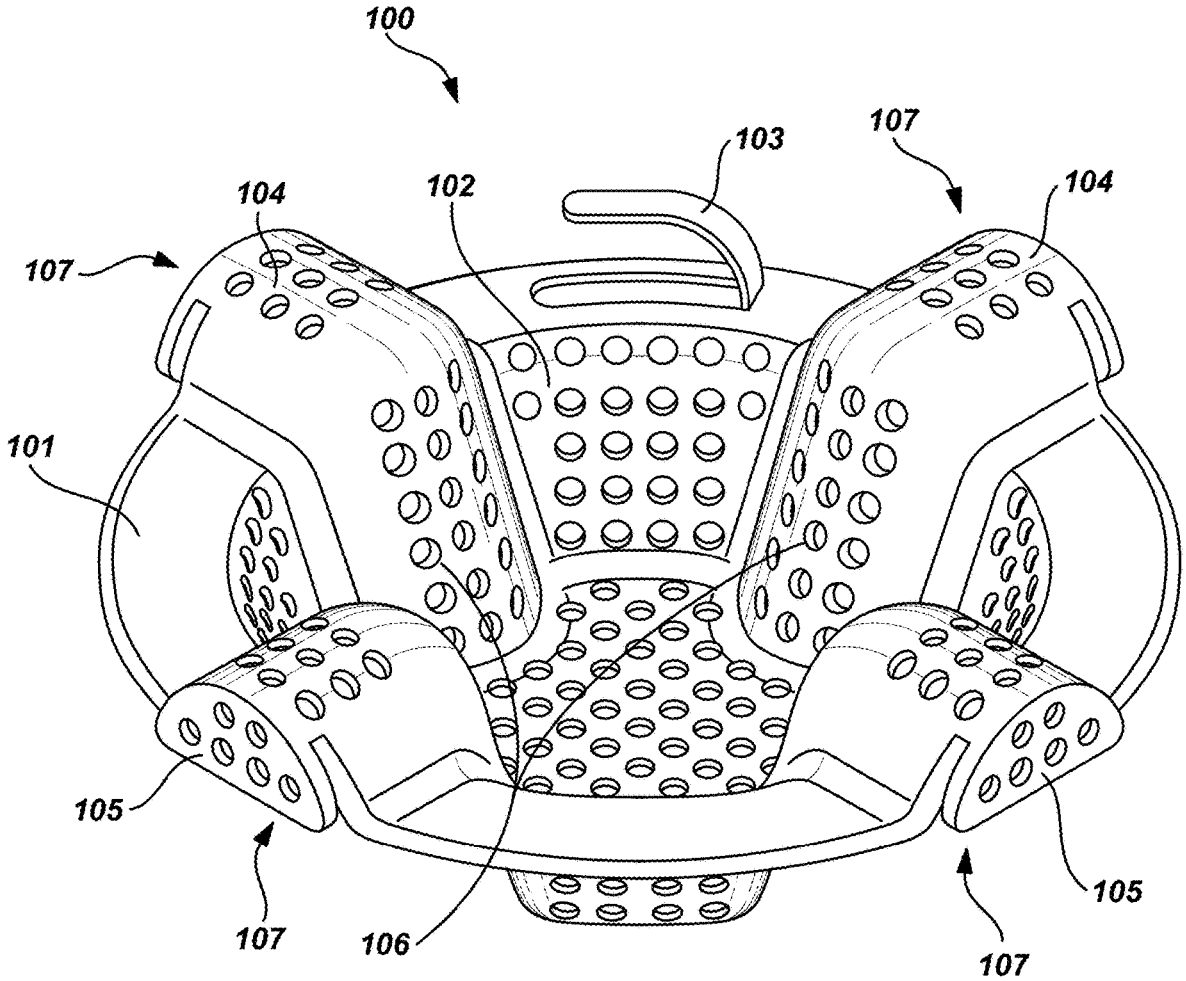
FIG. 1B is a top perspective view of another, preferred embodiment of the present invention.

FIGS. 1A and 1B are each a top perspective view of different embodiments of the present sink strainer 100. The sink strainer 100 has a rim 101 that is adapted to sit on top of the drain at the bottom of a sink, especially kitchen sinks. The rim 101 is connected to a perforated cup 102 that extends a distance down the drain of the sink. The most important feature of the sink strainer 100 are the four perforated water flow channels 107 that are equally spaced around the sink strainer 100. The perforated water flow channels 107 increase the water flowable area of the sink strainer 100 thereby increasing water flow efficiency and allowing the sink strainer 100 to continue to allow water to flow therethrough, even when covered with food debris.

Each water flow channel 107 includes a perforated face plate 105, a perforated upper ridge 104 and a perforated lower tunnel 106. Each of the perforated sections 104, 105 & 106 add water flowable area to the sink strainer 100. Additionally, there are gaps between each face plate 105 and the rim 101 that add even more water flowable area to the sink strainer 100. These perforated water flow channels 107 are the end result of multiple trial and error attempts to find the most efficient water flow design for sink strainers. The present sink strainer 100 provides a solution to a long-felt need in the industry for a strainer that does not clog.

The sink strainer 100 further includes a finger grip 103 that allows the strainer 100 to be easily removed from the sink. The finger grip 103 is preferably attached to the exterior circumference of the rim 101. This allows for maximum leverage when lifting the sink strainer 100 out of the sink. This is helpful when a seal has formed between the rim 101 and the sink. Of course, the finger grip 103 could be attached to other locations on the sink strainer 100. The sink strainer 100, including the finger grip 103, is preferably made of metal or a metallic alloy.

Figure 2:
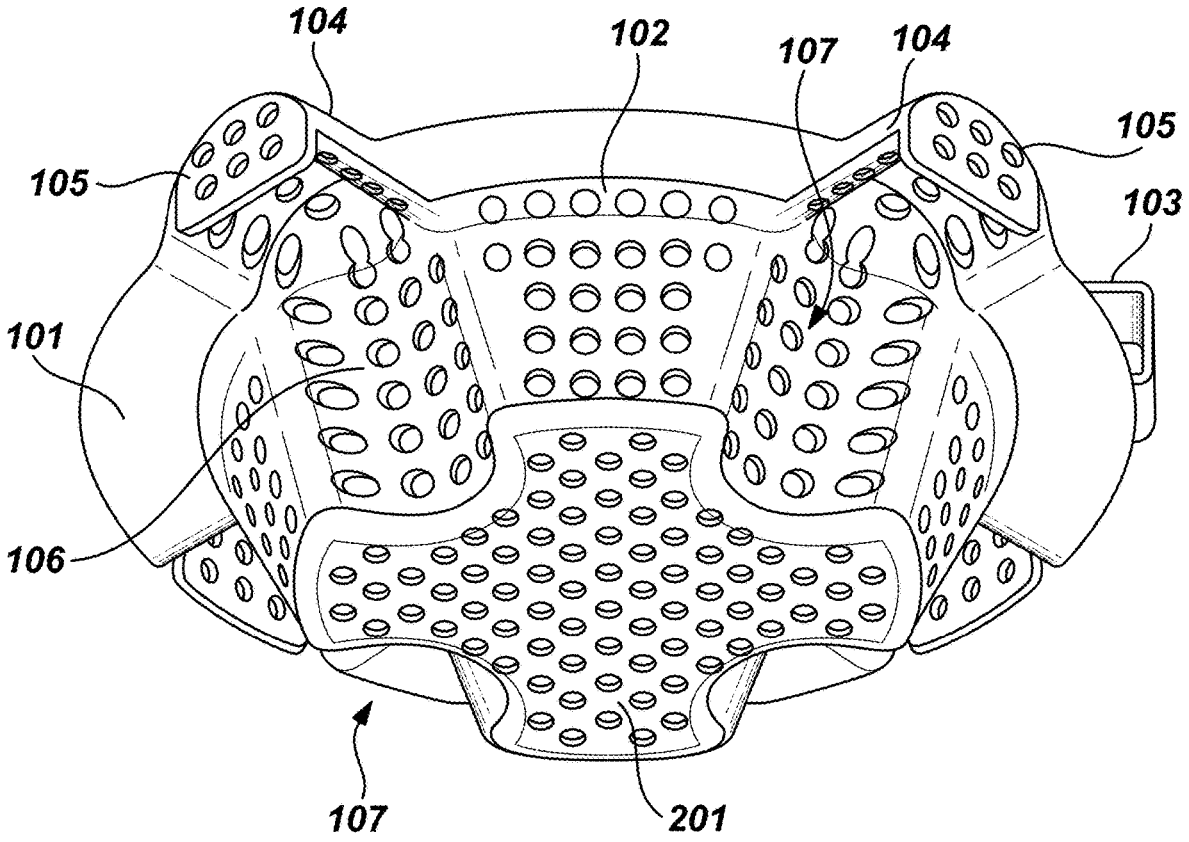
FIG. 2 is a bottom perspective view of the preferred embodiment of the present invention.

FIG. 2 is a bottom perspective view of the preferred embodiment of the present sink strainer 100. Looking at the bottom of the sink strainer 100 shows us the bottom 201 of the perforated cup 102, which also defines the bottom 201 of the strainer 100. Looking at the bottom 201 of the sink strainer 100 also shows the interior of the perforated water flow channels 107. The exterior of the water flow channels 107 are defined by the face plates 105, the upper ridges 104 and the lower tunnels 106. Because the exterior sections 104, 105 & 106 are perforated, they allow water through the strainer 100 and create channels for water to flow into the drain. The rim 101 of the sink strainer 100 provides a base for the strainer 100 and is adapted to sit on top of the drain of the sink. The finger grip 103 is attached to the rim 101 and provides for easy removal of the sink strainer 100 from a sink.

Figure 3:
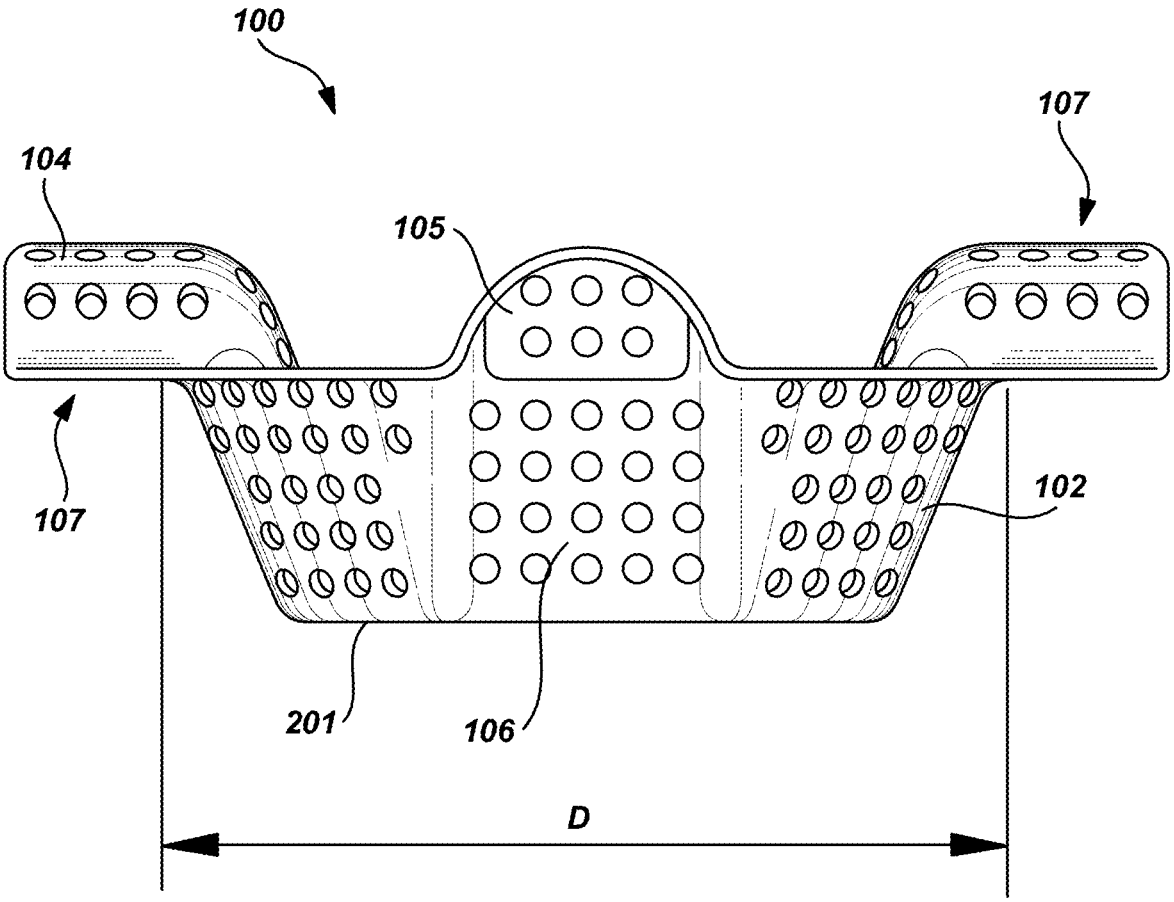
FIG. 3 is a side view of the preferred embodiment of the present invention; and, FIG. 4 is a flow chart showing exemplary steps in a method for using the preferred embodiment of the present invention.

FIG. 3 is a side view of the preferred embodiment of the present sink strainer 100. The distance D is the diameter of the top portion of the perforated cup 102 of the sink strainer 100. The distance D is also preferably the diameter of the drain in the sink. As shown in FIG. 3, the diameter of the perforated cup 102 decreases as it goes down to the bottom 201. This increases the space for water to flow between the cup 102 and the sides of the drain. Each water flow channel 107 also provides additional space for water to flow through the strainer 100 and into the drain. This can be seen in lower tunnel 106 and upper ridge 104 which create the additional space for the water to flow. The face plate 105 of each perforated water flow channel 107 further creates additional space for water to flow. Each perforated face plate 105 is located at the outer edge of the rim of the strainer 100 and allows water to enter the strainer 100 at that location. The outer edge of a rim is not even an option for entry of water in traditional strainers. Further, the top of the face plate 105 is attached to the top of the upper ridge 104. The sides of the face plate 105 are not attached to the sides of the upper ridge 104. This leaves a gap on the sides of each face plate 105, which is another entry spot for water to enter the strainer 100 and flow through the water flow channel 107.

Figure 4:
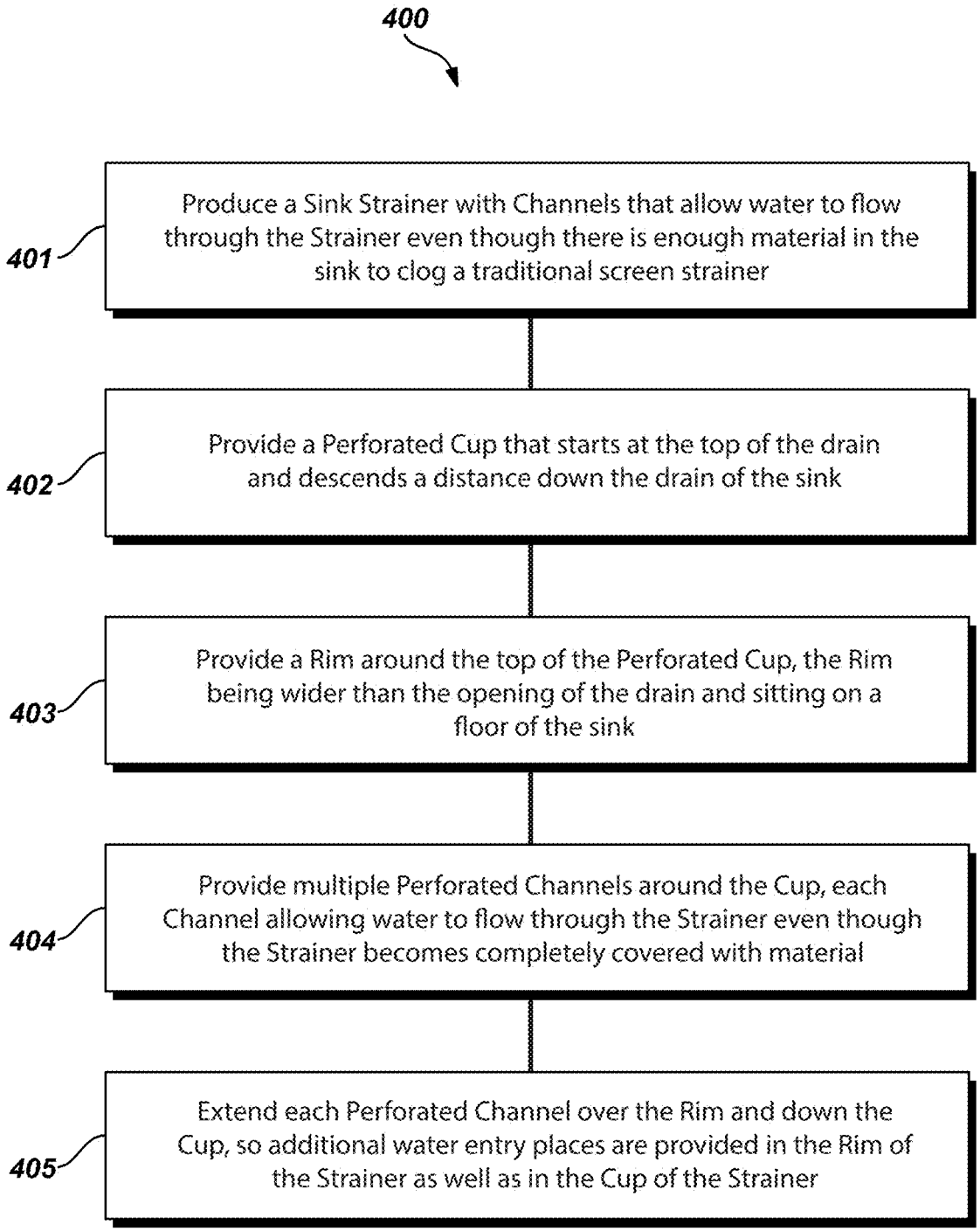

FIG. 4 is a flow chart 700 showing exemplary steps in a method for producing the preferred embodiment of the present sink strainer. Step 401 states the problem to be solved, produce a strainer with water flow channels that will allow water to continue to flow through the strainer, even when the strainer is covered with food debris. In step 402, a perforated cup is provided. The perforated cup starts at the top of the drain and extends a distance down the drain. The cup preferably tapers inwardly, slightly as it descends down the drain, as shown in FIG. 3. In step 403, a rim is provided around the top of the perforated cup. The rim is wider than the drain and allows the strainer to sit on top of the drain. In step 404, the key feature of the strainer, the perforated water flow channels are added. Four water flow channels are provided in the preferred embodiment, and each water flow channel increases the water flow efficiency of the strainer. Together, the four water flow channels allow the strainer to drain water, even when the strainer is covered with food debris. The final step 405 is to extend the perforated water flow channels over the rim and down the cup of the strainer, all the way to the bottom. This provides multiple water entry places in the rim of the strainer and increases the number of water entry spots in the perforated cup of the strainer.

In some embodiments, the sink strainer (100) may incorporate additional features to enhance functionality and user experience. For instance, the strainer (100) may be designed with mechanisms allowing partial disassembly, facilitating easy cleaning of all components. This feature, while not illustrated, could involve separable connections between the rim (101), perforated cup (102), and water flow channels (107).

The strainer (100) may also include additional elements sandwiched between the rim (101) and the perforated cup (102) to provide extra structure or functionality. These elements, not shown in the figures, could enhance the strainer's durability or introduce new features. In some cases, a top mechanism may be incorporated to plug the strainer (100), effectively sealing the sink drain when desired. This plugging mechanism, though not depicted, could integrate seamlessly with the existing structure of the strainer (100).

While the described embodiments are primarily intended for kitchen sinks, the sink strainer (100) may be adapted for use in various drains across different industries. The overall design and dimensions of the strainer (100) can be scaled to accommodate different drain sizes and applications. In some variations, the strainer (100) may include a compartment, not shown, designed to hold a freshening pod, helping to maintain a pleasant odor in the sink area.

For enhanced portability and storage, some embodiments of the sink strainer (100) may be collapsible. This feature, although not illustrated, could allow the strainer (100) to be compressed when not in use, making it more convenient for travel or storage in small spaces. Additionally, while the described embodiment implies multiple components, it's worth noting that in some variations, the entire strainer (100) could be constructed as a single, integrated piece, combining the rim (101), perforated cup (102), and water flow channels (107) into one unified structure.

While a particular form of the invention has been illustrated and described, it will be apparent that various modifications can be made without departing from the spirit and scope of the invention. For example, the entire rim could be a raised ridge with perforations around the entire circumference and edge of the rim. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A sink strainer (100) for preventing clogs in a sink drain, comprising:

a rim (101) adapted to sit on the sink drain, the rim (101) having an exterior circumference greater than the sink drain's circumference and an interior circumference;

a perforated cup (102) extending from the rim (101), the cup (102) comprising:

a circular top portion connected to the rim's (101) interior circumference, a perforated bottom portion (201), and a perforated cylindrical wall connecting the top and bottom portions;

multiple perforated water flow channels (107), each channel comprising:

a perforated face plate (105) extending above the rim's (101) exterior circumference, a perforated upper ridge (104) extending above the rim (101), connecting the face plate (105) to the cup (102), and a perforated lower tunnel (106) extending above the cup's (102) cylindrical wall, connecting the upper ridge (104) to the perforated bottom portion (201);

wherein the water flow channels (107) allow water to flow through the strainer (100) and into the drain.

2. The sink strainer (100) of claim 1 wherein the strainer (100) is adapted to be placed at the bottom of a kitchen sink.

3. The sink strainer (100) of claim 1 wherein four perforated water flow channels (107) are provided, and the four perforated water channels (107) are equally spaced apart within the cup (102) of the sink strainer (100).

4. The sink strainer (100) of claim 1, wherein the perforated bottom portion (201) of the cup (102) is flat.

5. The sink strainer (100) of claim 1 wherein the strainer (100) is made of metal or a metallic alloy.

6. The sink strainer (100) of claim 1 further comprising a finger grip (103), wherein the finger grip (103) is attached to the rim (101) of the strainer (100) and for assisting in removing the strainer (100) from the sink.

7. A sink strainer (100) for preventing clogs in a sink drain, comprising:

a rim (101) adapted to sit on the sink drain, the rim (101) having an exterior circumference greater than the drain's circumference and an interior circumference;

a perforated cup (102) extending from the rim (101), the cup (102) comprising:

a circular top portion connected to the rim's (101) interior circumference, a flat perforated bottom portion (201), and a perforated cylindrical wall connecting the top and bottom portions;

four equally spaced perforated water flow channels (107), each channel comprising:

a perforated face plate (105) extending above the rim's (101) exterior circumference, a perforated upper ridge (104) extending above the rim (101), connecting the face plate (105) to the cup (102), and a perforated lower tunnel (106) extending above the cup's (102) cylindrical wall, connecting the upper ridge (104) to the perforated bottom portion (201);

a finger grip (103) attached to the rim (101) for assisting in removing the strainer (100);

wherein:

the strainer (100) is made of metal or a metallic alloy, and the water flow channels (107) allow water to flow through the strainer (100) and into the drain.

8. A method of preventing clogs in a sink having a sink drain, comprising:

providing a sink strainer (100) comprising:

a rim (101) adapted to sit on a sink drain, the rim (101) having an exterior circumference greater than the drain's circumference and an interior circumference;

a perforated cup (102) extending from the rim (101), the cup (102) comprising:

a circular top portion connected to the rim's (101) interior circumference, a perforated bottom portion (201), and a perforated cylindrical wall connecting the top and bottom portions;

multiple perforated water flow channels (107), each channel comprising:

a perforated face plate (105) extending above the rim's (101) exterior circumference, a perforated upper ridge (104) extending above the rim (101), connecting the face plate (105) to the cup (102), and a perforated lower tunnel (106) extending above the cup's (102) cylindrical wall, connecting the upper ridge (104) to the perforated bottom portion (201);

wherein the water flow channels (107) allow water to flow through the strainer (100) and into the drain; and placing the sink strainer in the sink drain.

9. The method of claim 8, further comprising the step of providing a finger grip (103), wherein the finger grip (103) is attached to the rim (101) of the strainer (100) and facilitates removing the strainer (100) from the sink.

* * * * *